US008965242B2

(12) United States Patent
Kuriki

(10) Patent No.: US 8,965,242 B2
(45) Date of Patent: Feb. 24, 2015

(54) DEVELOPING DEVICE HAVING DEVELOPER BEARING MEMBER AND LAYER THICKNESS REGULATING MEMBER

(71) Applicant: Hirofumi Kuriki, Nagoya (JP)

(72) Inventor: Hirofumi Kuriki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 40 days.

(21) Appl. No.: 13/752,783

(22) Filed: Jan. 29, 2013

(65) Prior Publication Data

US 2013/0195502 A1 Aug. 1, 2013

(30) Foreign Application Priority Data

Jan. 31, 2012 (JP) ..... 2012-018201

(51) Int. Cl.
*G03G 15/08* (2006.01)

(52) U.S. Cl.
CPC ..... *G03G 15/0817* (2013.01)
USPC ..... 399/105; 399/103

(58) Field of Classification Search
CPC ..... G03G 15/0812; G03G 15/0898; G03G 15/0817; G03G 2221/1648
USPC ..... 399/103, 105, 274
See application file for complete search history.

(56) References Cited

U.S. PATENT DOCUMENTS

2008/0080888 A1* 4/2008 Ito ..... 399/103

FOREIGN PATENT DOCUMENTS

JP 04-208961 A 7/1992
JP 2011-237607 A 11/2011

OTHER PUBLICATIONS

Jul. 29, 2014—(CN) First Office Action—App 201310038820.5.

* cited by examiner

*Primary Examiner* — Gregory H Curran
(74) *Attorney, Agent, or Firm* — Banner & Witcoff, Ltd.

(57) ABSTRACT

In a developing device, a layer thickness regulating member, configured to regulate thickness of a layer of developer borne on a surface of a developer bearing member, includes: a first plate-shaped member having a pair of opposite ends in a perpendicular direction perpendicular to an axial direction of the developer bearing member, one end in the pair of opposite ends being in contact with the developer bearing member, the other end being supported by the casing; and a second plate-shaped member that is fixedly secured to the casing and that supports the first plate-shaped member. A seal member, which is in contact with an end portion of the developer bearing member in the axial direction of the developer bearing member, is in contact with an end portion of the first plate-shaped member in the axial direction of the developer bearing member. The second plate-shaped member holds the seal member.

17 Claims, 8 Drawing Sheets

DEVELOPING DEVICE HAVING DEVELOPER BEARING MEMBER AND LAYER THICKNESS REGULATING MEMBER

CROSS REFERENCE TO RELATED APPLICATION

This application claims priority from Japanese Patent Application No. 2012-018201 filed Jan. 31, 2012. The entire content of this priority application is incorporated herein by reference.

TECHNICAL FIELD

The present invention relates to a developing device that is for being mounted in an image forming apparatus, such as a color printer.

BACKGROUND

There has been conventionally known an electrophotographic type printer to which a developing device is detachably attached. The developing device includes a casing, a developing roller supported by the casing and bearing toner thereon, and a layer thickness regulating member that regulates thickness of a layer of toner formed on a surface of the developing roller.

There has been proposed, as such a developing device, a developing device having a configuration in which the layer thickness regulating member includes a thin plate spring having substantially a flat-plate shape, a chip which is made of a rubber member and provided at a free end portion of the thin plate spring, and a pair of seal members which are provided on a pair of longitudinal ends of the thin plate spring so as to be disposed adjacent to the chip in the longitudinal direction.

In the developing device of this type, the chip constituting the layer thickness regulating member is brought into contact with the developing roller to regulate the layer thickness of toner carried on the surface of the developing roller. The seal members are each disposed between the longitudinal end portion of the thin plate spring and an axial end portion of the developing roller, and therefore prevent leakage of toner from between the longitudinal end portion of the thin plate spring and the axial end portion of the developing roller.

In recent years, there is an increasing demand to reduce the number of parts constituting a developing device, in order to reduce a manufacturing cost of the developing device. So, such a layer thickness regulating member has been proposed, in which the free end portion of a thin plate spring is provided with no chip, and therefore is brought into direct contact with a developing roller to regulate the layer thickness of toner carried on the surface of the developing roller. This layer thickness regulating member will be referred to as "no-chip-mounted layer thickness regulating member", hereinafter.

SUMMARY

It is conceivable to provide the no-chip-mounted layer thickness regulating member with the conventional seal members described above such that the seal members are provided on the pair of longitudinal end portions of the thin plate spring. In this conceivable configuration, however, a gap may be generated, due to thickness of the seal members, between the free end portion of the thin plate spring and the developing roller. So, the layer thickness of toner carried on the surface of the developing roller cannot be regulated adequately, and further toner may leak from the gap between the free end portion of the thin plate spring and the developing roller.

An object of the present invention is, therefore, to provide an improved developing device that is capable of reliably regulating the layer thickness of developer borne on the surface of a developer bearing member and that is capable of preventing leakage of developer from the casing of the developing device, while reducing the number of parts constituting the developing device.

In order to attain the above and other objects, the invention provides a developing device including: a casing; a developer bearing member; a layer thickness regulating member; and a seal member. The casing is configured to accommodate developer therein. The developer bearing member is mounted in the casing so as to be rotatable about its axis and configured to bear developer thereon. The layer thickness regulating member is mounted in the casing and configured to regulate thickness of a layer of developer borne on a surface of the developer bearing member. The seal member is in contact with an end portion of the developer bearing member in an axial direction of the developer bearing member. The layer thickness regulating member includes: a first plate-shaped member having a pair of opposite ends in a perpendicular direction that is perpendicular to the axial direction of the developer bearing member, one end in the pair of opposite ends being in contact with the developer bearing member, the other end being supported by the casing; and a second plate-shaped member that is fixedly secured to the casing and that supports the first plate-shaped member. The seal member is in contact with an end portion of the first plate-shaped member in the axial direction of the developer bearing member. The second plate-shaped member holds the seal member.

BRIEF DESCRIPTION OF THE DRAWINGS

The particular features and advantages of the invention as well as other objects will become apparent from the following description taken in connection with the accompanying drawings, in which:

FIGS. 6A and 6B illustrate how a blade member and a side edge seal contact a developing roller, wherein FIG. 6A illustrates a state before the blade member and side edge seal contact the developing roller, and FIG. 6B illustrates a state where the blade member and side edge seal contact the developing roller;

FIGS. 7A and 7B illustrate how a blade member and a side edge seal in a developing cartridge according to a second embodiment contact a developing roller, wherein FIG. 7A illustrates a state before the blade member and side edge seal contact the developing roller, and FIG. 7B illustrates a state where the blade member and side edge seal contact the developing roller.

DETAILED DESCRIPTION

Figure 1:
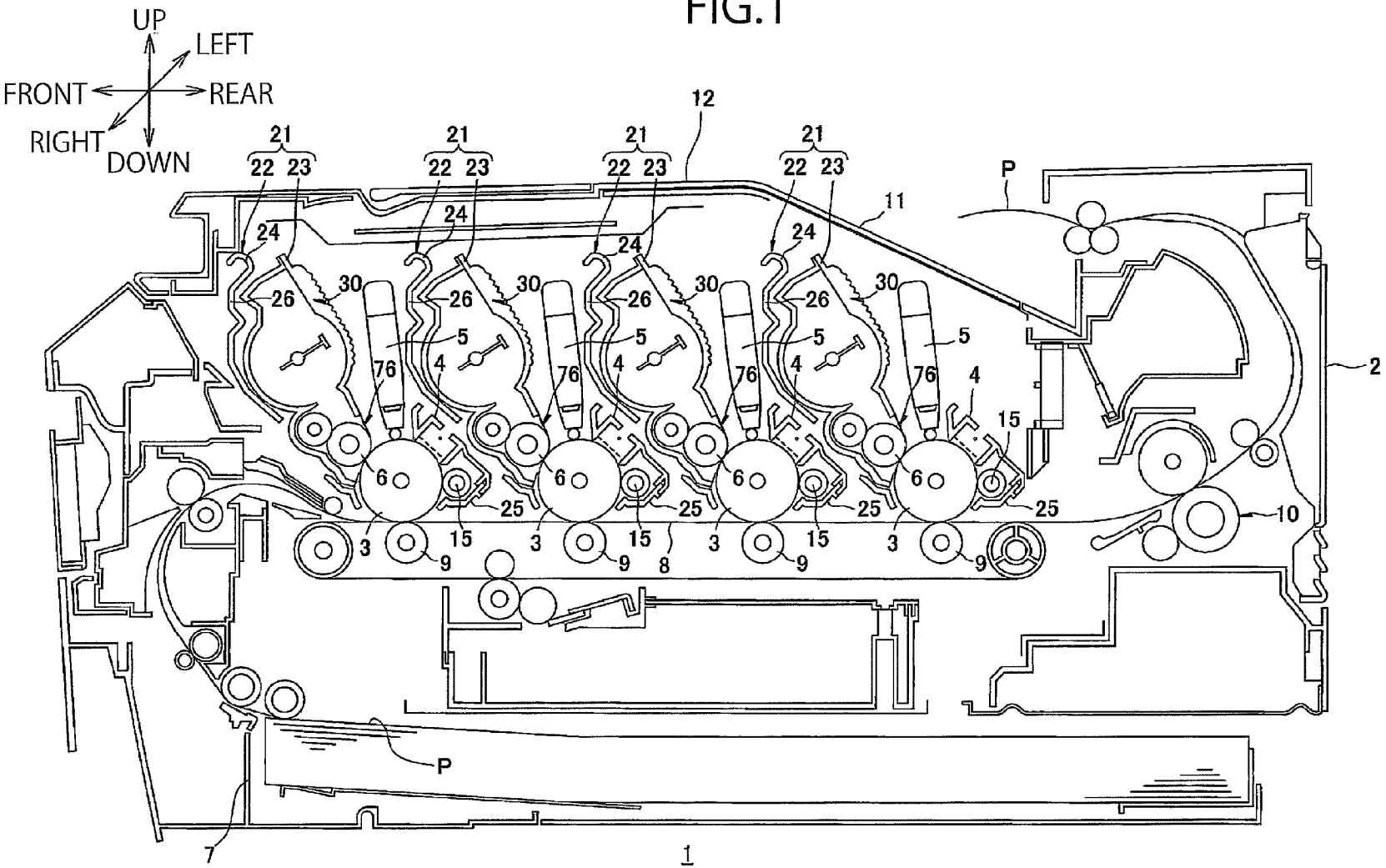
FIG. 1 is a side cross-sectional view of a printer according to a first embodiment of the present invention.

A developing device according to embodiments of the invention will be described while referring to the accompanying drawings wherein like parts and components are designated by the same reference numerals to avoid duplicating description.

1. Printer

As illustrated in FIG. 1, a printer 1 according to a first embodiment of the present invention is a color printer of a direct tandem type.

The terms of directions, such as "upward", "downward", "upper", "lower", "above", "below", "beneath", "right", "left", "front", "rear" and the like, for the printer 1 will be used throughout the description assuming that the printer 1 is disposed in a horizontal orientation in which the printer 1 is intended to be used. FIG. 1 shows the state that the printer 1 is disposed in the horizontal orientation. The directions for the printer 1 are therefore indicated in FIG. 1.

Figure 2:
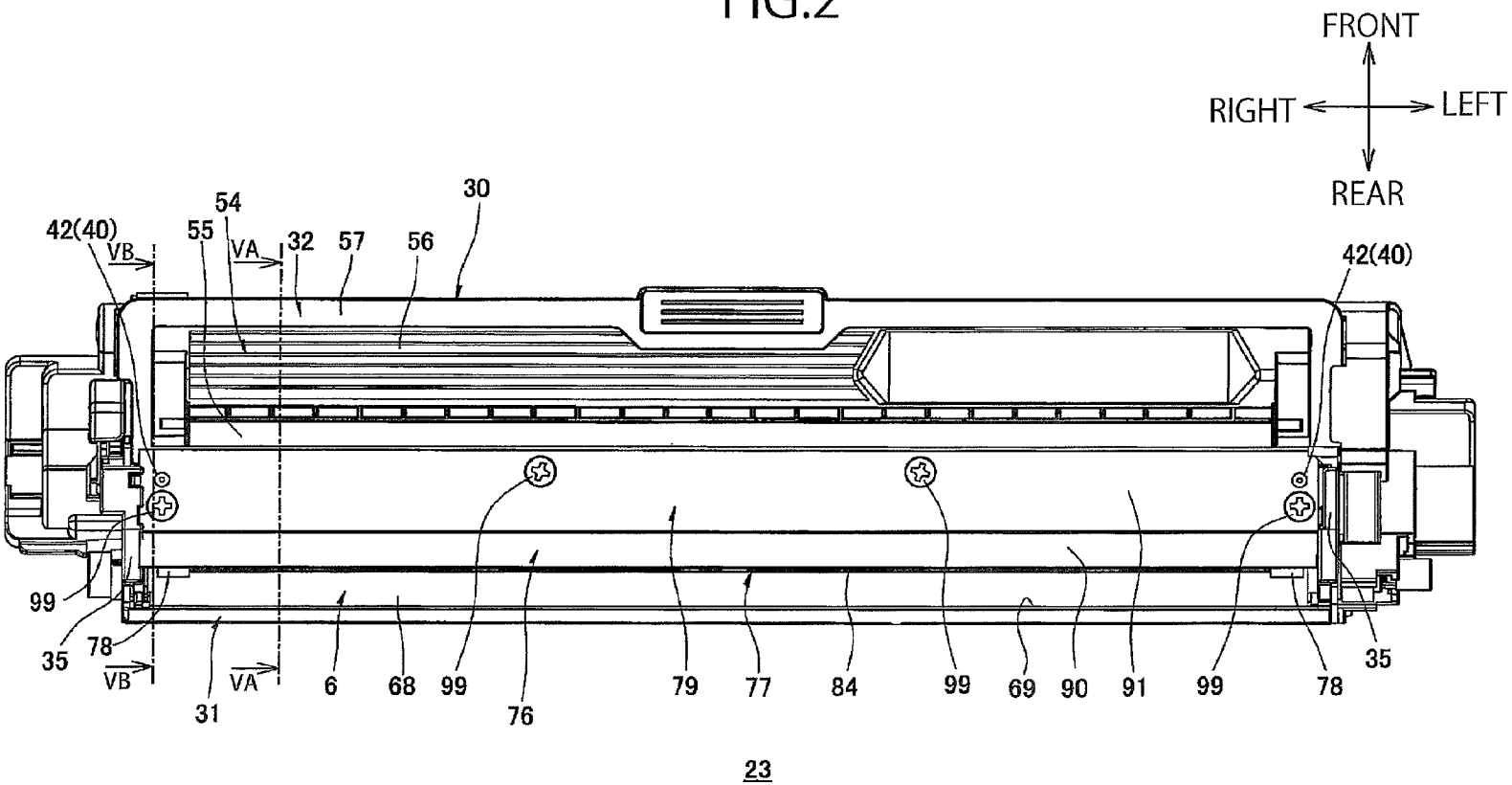
FIG. 2 is a plan view of a developing cartridge according to the first embodiment.

The terms of directions, such as "upward", "downward", "upper", "lower", "above", "below", "beneath", "right", "left", "front", "rear" and the like, for a developing cartridge 23 (to be described later) will be used throughout the description assuming that the developing cartridge 23 is disposed outside the printer 1 and is disposed in a horizontal orientation in which the developing cartridge 23 is normally disposed when the developing cartridge 23 is outside the printer 1. FIG. 2 shows the state that the developing cartridge 23 is disposed in the horizontal orientation when the developing cartridge 23 is disposed outside the printer 1. The directions for the developing cartridge 23 are indicated in FIGS. 2-6B.

That is, up-down and front-rear directions defined for the printer 1 and those defined for the developing cartridge 23 differ from each other. More specifically, the developing cartridge 23 is attached to the printer 1 such that front and rear sides of the developing cartridge 23 are disposed facing upper-front and lower-rear sides of the printer 1, respectively.

The printer 1 includes a main casing 2. In the main casing 2, a plurality of (four) photosensitive drums 3 are juxtaposed along the front-rear direction for the printer 1. The plurality of (four) photosensitive drums 3 correspond to respective colors (black, yellow, magenta, and cyan) of a toner image (to be described later).

A scorotron charger 4, an LED unit 5, and a developing roller 6 are disposed opposite to each photosensitive drum 3.

The photosensitive drum 3 is uniformly charged on a surface thereof by the scorotron charger 4 and thereafter exposed by the LED unit 5. As a result, an electrostatic latent image is formed on the surface of the photosensitive drum 3 based on image data. The electrostatic latent image is developed by toner borne or carried on the developing roller 6. So, a toner image is formed on the surface of the photosensitive drum 3.

Sheets P are accommodated in a sheet cassette 7 provided in the main casing 2. The sheets P accommodated in the sheet cassette 7 are fed one sheet at a time to a conveying belt 8 by various rollers.

The conveying belt 8 is disposed between the plurality of (four) photosensitive drums 3 and transfer rollers 9 facing the photosensitive drums 3, respectively. The toner image on the surface of the photosensitive drum 3 is transferred by a transfer bias applied to the transfer roller 9, onto a sheet P conveyed by the conveying belt 8. With this operation, the toner images formed on the four photosensitive drums 3 are sequentially transferred onto the sheet P in an overlapping manner as one toner image.

The sheet P onto which the toner image including four colors has been transferred is conveyed to a fixing portion 10. The toner image thus transferred onto the sheet P is thermally fixed by the fixing portion 10. Thereafter, the sheet P is discharged onto a discharge tray 11 by various rollers.

2. Process Cartridge

The printer 1 includes a plurality of (four) process cartridges 21 which correspond to respective colors (black, yellow, magenta and cyan).

The process cartridges 21 are detachably attached in the main casing 2 and are juxtaposed in the main casing 2 along the front-rear direction for the printer 1.

A top cover 12 is openably/closably mounted to an upper wall of the main casing 2, and the process cartridges 21 can be attached to and detached from the main casing 2 in a state where the top cover 12 is opened.

Each process cartridge 21 includes a drum cartridge 22 detachably attached to the main casing 2 and a developing cartridge 23 detachably attached to the drum cartridge 22.

(1) Drum Cartridge

The drum cartridge 22 includes a drum frame 24. The drum frame 24 includes a drum support portion 25 and a developing cartridge accommodating portion 26.

The drum support portion 25 is provided on the lower-rear side of the drum frame 24 so as to support the photosensitive drum 3, the scorotron charger 4, and a drum cleaning roller 15.

The photosensitive drum 3 is substantially in a cylindrical shape elongated in the left-right direction. The photosensitive drum 3 is rotatably supported at a lower end of the drum support portion 25 so as to be exposed from the lower surface of the drum support portion 25. The scorotron charger 4 is disposed so as to be opposed to and spaced apart from the photosensitive drum 3 at the upper-rear side of the photosensitive drum 3. The drum cleaning roller 15 is disposed so as to be opposed to and contact the photosensitive drum 3 at the rear side of the photosensitive drum 3.

The developing cartridge accommodating portion 26 is disposed at the upper-front side of the drum support portion 25 and is opened rearward and upward so as to allow the developing cartridge 23 to be detachably attached to the developing cartridge accommodating portion 26.

(2) Developing Cartridge

Figure 3:
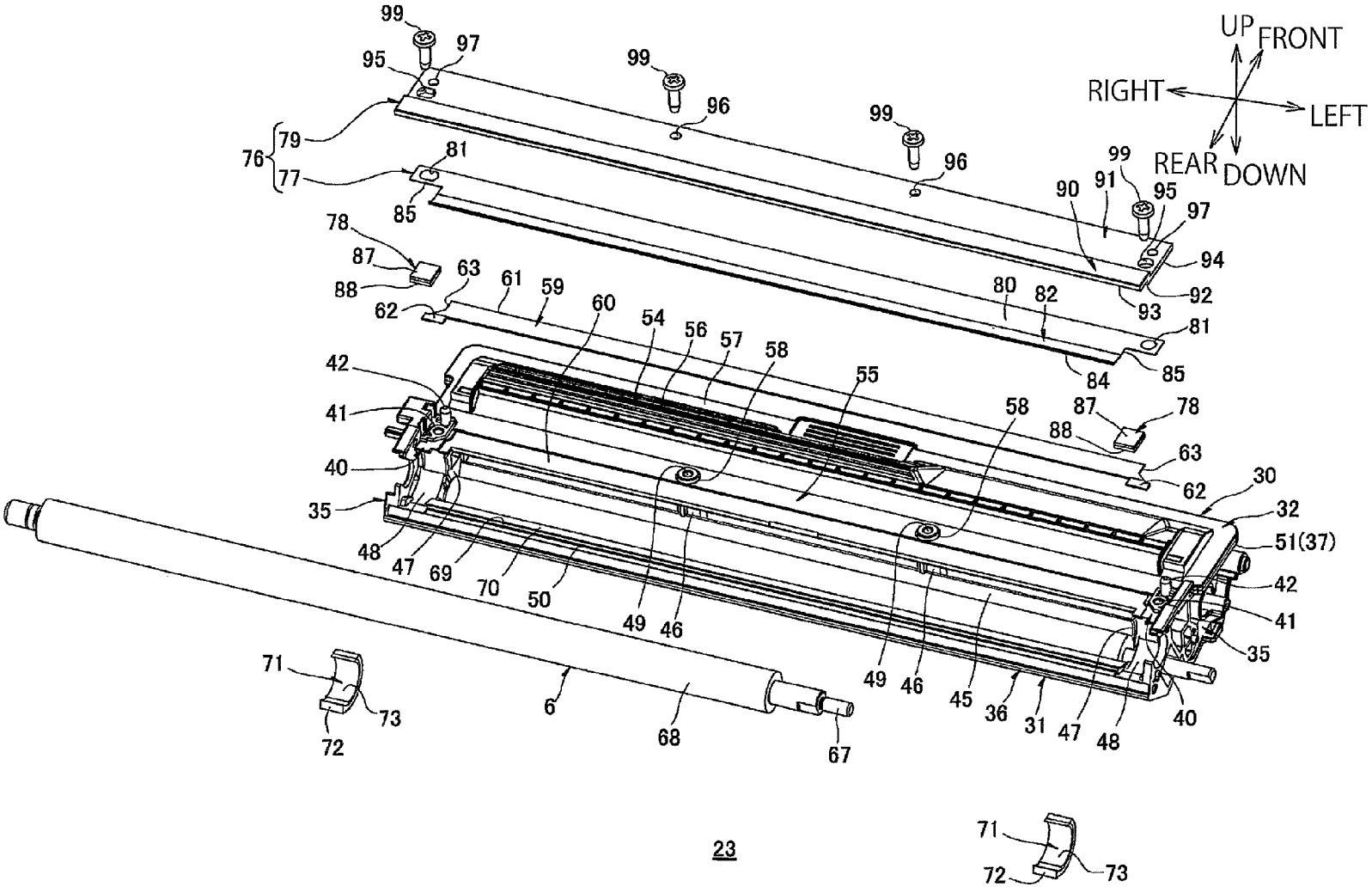
FIG. 3 is an exploded perspective view of the developing cartridge shown in FIG. 2.

As illustrated in FIGS. 2 and 3, the developing cartridge 23 includes a developing frame 30.

Figure 5A:
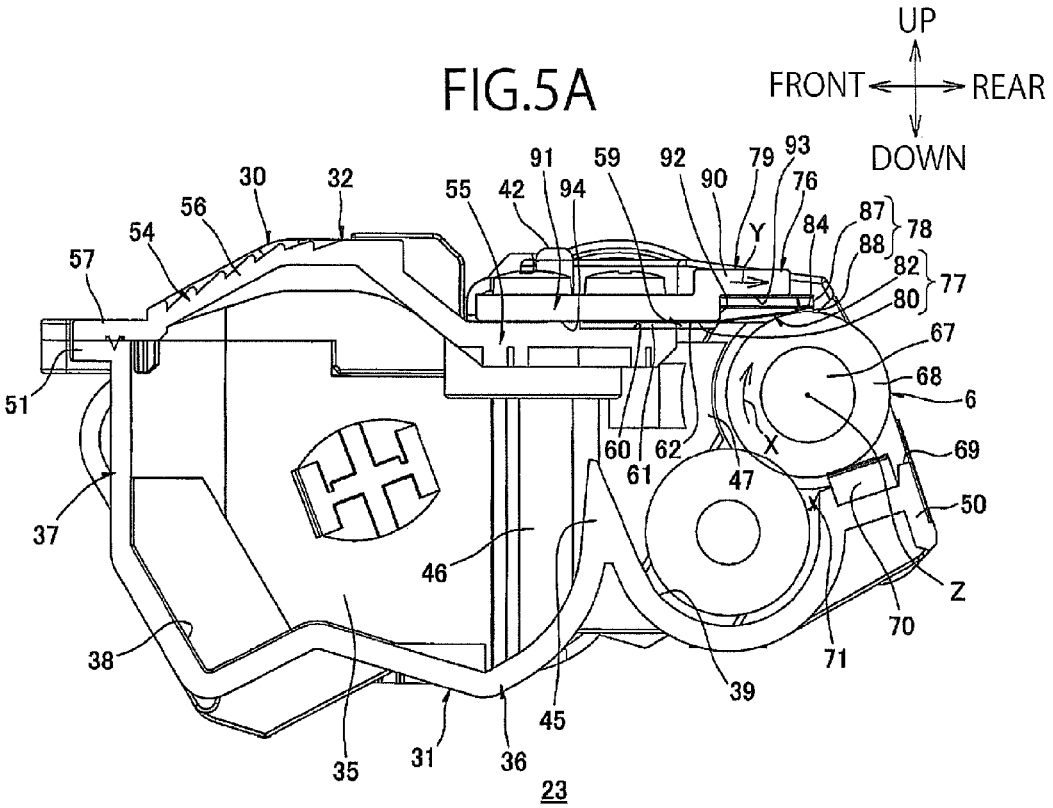
FIG. 5A is a cross-sectional view taken along a line VA-VA in FIG. 2.

The developing frame 30 is substantially in a box-shape elongated in the left-right direction, and includes a lower frame 31 and an upper frame 32 fitted to the lower frame 31 (see FIG. 5A).

(2-1) Lower Frame

As illustrated in FIG. 3, the lower frame 31 integrally includes: a pair of side walls 35 disposed opposite to and spaced apart from each other in the left-right direction; a bottom wall 36 connecting lower end portions of the side walls 35; and a front wall 37 (see FIG. 5A) connecting front end portions of the side walls 35 and bottom wall 36.

Each of the pair of side walls 35 is substantially in a flat-plate shape. The side walls 35 include a left side wall 35 disposed on the left and a right side wall 35 disposed on the right. A first fixing portion 40 is formed on an inner side surface of each side wall 35 in the left-right direction. That is, one first fixing portion 40 (left-side first fixing portion 40) is formed on a right side surface of the left side wall 35, and another first fixing portion 40 (right-side first fixing portion 40) is formed on a left side surface of the right side wall 35.

Each first fixing portion 40 is substantially in a flat-plate shape that extends continuously from an upper end of the corresponding side wall 35 inward in the left-right direction. That is, the left-side first fixing portion 40 is substantially in a flat-plate shape that extends continuously from an upper end of the left side wall 35 rightward, and the right-side first fixing portion 40 is substantially in a flat-plate shape that extends continuously from an upper end of the right side wall 35 leftward. A first screw hole 41 and a positioning protrusion 42 are formed in each first fixing portion 40.

The first screw hole 41 is positioned at a center portion of the first fixing portion 40 in the front-rear direction, and penetrates the plate-shaped first fixing portion 40 in the up-down direction (vertical direction).

The positioning protrusion 42 is positioned on the front side of the first screw hole 41. The positioning protrusion 42 is substantially in a columnar shape protruding upward from the first fixing portion 40. A tip end portion of the positioning protrusion 42 is formed into substantially a circular arc shape in cross section bulging upward.

As illustrated in FIG. 5A, the bottom wall 36 is formed such that a front side of the bottom wall 36 has substantially a W-shape in side cross section and a rear side of the bottom wall 36 has substantially a semi circular shape in side cross section opened upward.

The bottom wall 36 is integrally formed with a partition wall 45, a lower sponge holding portion 50, a plurality of (two) second fixing portions 46 (see FIG. 3), and a plurality of (two) bulkheads 47 (see FIG. 3).

The partition wall 45 is provided in a connecting portion between the front side and rear side portions of the bottom wall 36. The partition wall 45 is formed into substantially a triangle shape in side cross section protruding upward from the bottom wall 36. The partition wall 45 is elongated in the left-right direction (see FIG. 3).

The lower sponge holding portion 50 is formed into substantially a T-shape in side cross section protruding rearward from a rear end portion of the bottom wall 36.

The two second fixing portions 46 are disposed adjacent to the front side of the partition wall 45 and spaced apart from each other in the left-right direction, as illustrated in FIG. 3. Each of the second fixing portions 46 is formed into substantially a cylindrical shape extending upward from the bottom wall 36. A second screw hole 49 is formed in an upper end surface of the second fixing portion 46.

The bulkheads 47 are each formed into substantially a flat-plate shape protruding upward from an upper surface of the bottom wall 36 at a position rearward of the partition wall 45, as illustrated in FIG. 5A. The bulkheads 47 are disposed spaced apart inward from the both side walls 35 in the left-right direction, as illustrated in FIG. 3. That is, among the two bulkheads 47, one bulkhead 47 that is disposed on the left side (left side bulkhead 47) is disposed to the right of the left side wall 35 and is apart from the left side wall 35, and another bulkhead 47 that is disposed on the right side (right side bulkhead 47) is disposed to the left of the right side wall 35 and is apart from the right side wall 35.

A part of the lower frame 31 between each bulkhead 47 and a corresponding side wall 35 is defined as a side seal accommodating portion 48. That is, one side seal accommodating portion 48 (left side seal accommodating portion 48) is defined between the left side wall 35 and the left side bulkhead 47, and another side seal accommodating portion 48 (right side seal accommodating portion 48) is defined between the right side wall 35 and the right side bulkhead 47.

Figure 5B:
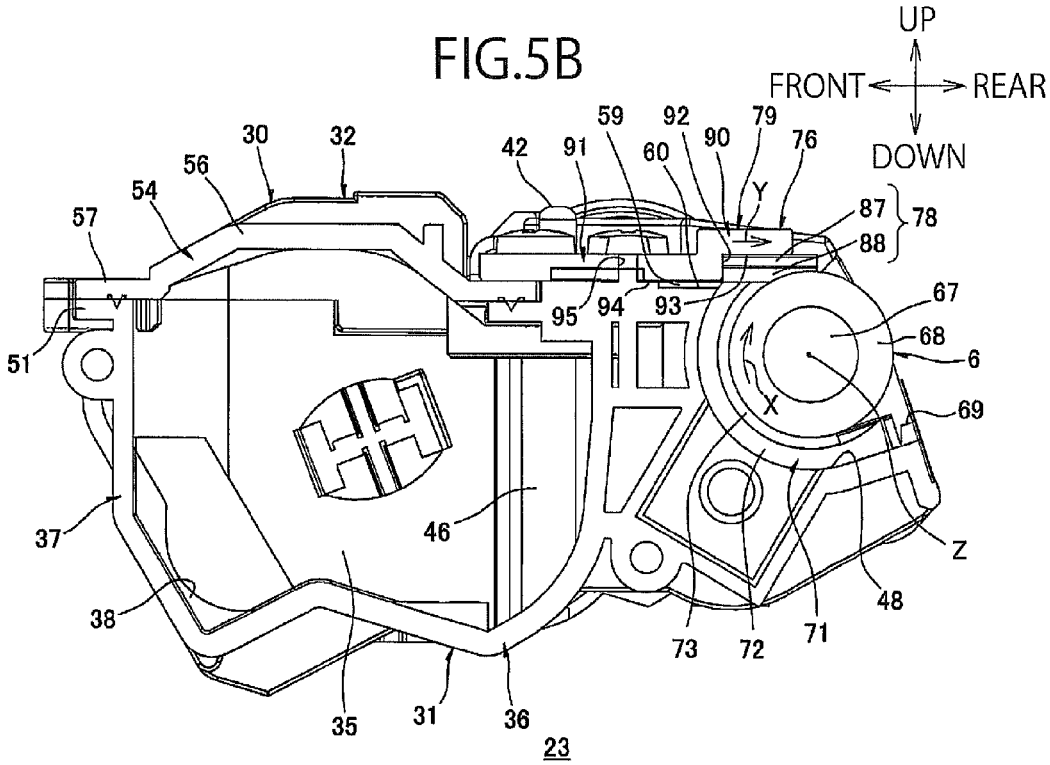
FIG. 5B is a cross-sectional view taken along a line VB-VB in FIG. 2.

As illustrated in FIG. 5B, the side seal accommodating portion 48 is formed into substantially C-shape in side cross section opened in the upper-rear direction.

As illustrated in FIG. 5A, the front wall 37 is formed continuously from the front end portion of the bottom wall 36 so as to extend upward.

An abutted portion 51 is formed at an upper end portion of the front wall 37. The abutted portion 51 is formed into substantially a flat-plate shape extending frontward continuously from the upper end of the front wall 37.

(2-2) Upper Frame

The upper frame 32 integrally includes a front-side upper wall 54 and a rear-side upper wall 55.

The front-side upper wall 54 includes a bulging portion 56 and an abutting portion 57.

As illustrated in FIG. 3, the bulging portion 56 is formed at a center portion of the front-side upper wall 54 so as to bulge upward.

The abutting portion 57 has substantially a flat-plate shape and is formed on left, right, and front sides of the bulging portion 56 so as to surround the bulging portion 56. The abutting portion 57 is formed so as to confront the abutted portion 51 and the front-side upper surfaces of the side walls 35 when the upper frame 32 and lower frame 31 are fitted to each other.

The rear-side upper wall 55 is formed into substantially a flat-plate shape extending rearward continuously from a rear end portion of the front-side upper wall 54. The rear-side upper wall 55 has a plurality of (two) upper frame through-holes 58. The upper frame through-holes 58 are formed in a front portion of the rear-side upper wall 55. The rear-side upper wall 55 further has a side upper seal accommodating portion 60 formed in a portion rearward of the upper frame through-holes 58.

The plurality of (two) upper frame through-holes 58, each of which has substantially a circular shape as viewed from above, are formed in correspondence with the plurality of (two) second fixing portions 46. A hole diameter of the upper frame through-hole 58 is larger than an outer diameter of the second fixing portion 46.

As illustrated in FIG. 5A, the side upper seal accommodating portion 60 is formed by cutting an upper-rear edge of the rear-side upper wall 55 into substantially an L-shape in side cross section. The side upper seal accommodating portion 60 is elongated over the entire length of the rear side portion of the rear-side upper wall 55 in the left-right direction.

As illustrated in FIG. 5A, a side upper seal 59 is accommodated in the side upper seal accommodating portion 60.

The side upper seal 59 is formed of elastic foam such as an urethane sponge member and has substantially a U-shape, as viewed from above, opened rearward, as illustrated in FIG. 3.

The side upper seal 59 includes an upper portion 61 and side portions 62.

The upper portion 61 is formed into substantially a rectangular shape, as viewed from above, elongated in the left-right direction and has lengths in the front-rear and left-right directions substantially equal to those of the side upper seal accommodating portion 60.

The side portions 62, each of which is formed into substantially a rectangular shape as viewed from above, protrude rearward from a pair of left and right end portions of the upper portion 61.

Seal cut portions 63 each cut into substantially a rectangular shape as viewed from above are formed in connecting portions between the upper portion 61 and side portions 62, respectively.

The seal cut portion 63 is formed so as to expose the first screw hole 41 and the positioning protrusion 42 of the first fixing portion 40 from above when the upper frame 32 and the lower frame 31 are fitted to each other.

A lower surface of the upper portion 61 is adhesively bonded to an upper surface of the side upper seal accommodating portion 60 to thereby fix the side upper seal 59 to the side upper seal accommodating portion 60.

(2-3) Developing Frame

As illustrated in FIG. 5A, the developing frame 30 is formed by fitting the upper frame 32 and the lower frame 31 to each other such that the abutting portion 57 of the upper frame 32 abuts against the abutted portion 51 and the front-side upper surfaces of the side walls 35 in the lower frame 31.

As illustrated in FIG. 3, in the developing frame 30, the plurality of (two) second fixing portions 46 of the lower frame 31 are inserted through the corresponding upper frame through-holes 58, respectively, and the second screw holes 49 are exposed through the upper frame through-holes 58 from the upper surface of the rear-side upper wall 55.

As illustrated in FIG. 5A, in the developing frame 30, a space on the front side relative to the partition wall 45 is defined as a toner chamber 38, and a space on the rear side relative to the partition wall 45 is defined as a developing chamber 39.

Toner of one of the four colors (black, yellow, magenta and cyan) is accommodated in the toner chamber 38.

The developing chamber 39 has an opening portion 69 opened rearward. More specifically, the opening portion 69 is defined by rear end portions of the both side walls 35, a rear end portion of the lower sponge holding portion 50, and a rear end portion of the rear-side upper wall 55.

The developing chamber 39 includes the developing roller 6, a lower sponge 70, a pair of (two) side seals 71 (see FIG. 3), a layer thickness regulating blade 76, and a pair of (two) side edge seals 78.

The developing roller 6 is disposed at a rear end portion of the developing chamber 39 such that a rear side and an upper side of the developing roller 6 are exposed through the opening portion 69.

As illustrated in FIG. 3, the developing roller 6 includes a developing roller shaft 67 and a rubber roller 68.

The developing roller shaft 67 is formed into substantially a columnar shape elongated in the left-right direction.

The rubber roller 68 is formed so as to cover the developing roller shaft 67, exposing both left and right end portions of the developing roller shaft 67.

The both left and right end portions of the developing roller shaft 67 are rotatably supported by the both side walls 35, respectively, and thereby the developing roller 6 is rotatably mounted to the developing frame 30.

At developing time, the developing roller 6 receives drive force from a drive source (not illustrated) such as a motor provided in the main casing 2. Further, the developing roller 6 is applied, at the developing time, with a developing bias from a power supply (not illustrated). Upon reception of the drive force from the drive source (not illustrated), the developing roller 6 rotates in a rotation direction X denoted by an arrow (clockwise direction as viewed from the right side) about its axis Z, as illustrated in FIG. 5A. As a result, toner supplied from the toner chamber 38 is borne or carried on a surface of the rubber roller 68.

As illustrated in FIG. 3, the lower sponge 70 is formed into substantially a rectangular shape as viewed from side, and is elongated in the left-right direction (see FIG. 5A). As illustrated in FIG. 5A, the lower sponge 70 is held on an upper surface of the lower sponge holding portion 50 so as to be opposed to and contact a lower portion of the developing roller 6.

As illustrated in FIG. 5B, the side seals 71 are each formed into substantially a C-shape, as viewed from side, opened rearward.

The side seal 71 includes a first base material 72 and a first raised fabric member 73.

The first base material 72 is formed of elastic foam such as an urethane sponge member and has substantially a C-shape, as viewed from side, opened rearward.

The first raised fabric member 73 is formed of fabric such as a fiber material of cashmere and has substantially a C-shape, as viewed from side, opened rearward.

The first raised fabric member 73 is adhesively bonded to a rear surface of the first base material 72 such that an upper end portion of the first raised fabric member 73 and an upper end portion of the first base material 72 are flush with each other.

The side seals 71 described above are accommodated in the side seal accommodating portions 48, respectively, so as to be brought into contact with a peripheral surface at both end portions of the rubber roller 68 in the left-right direction (see FIG. 3).

(2-4) Layer Thickness Regulating Blade

Figure 4:
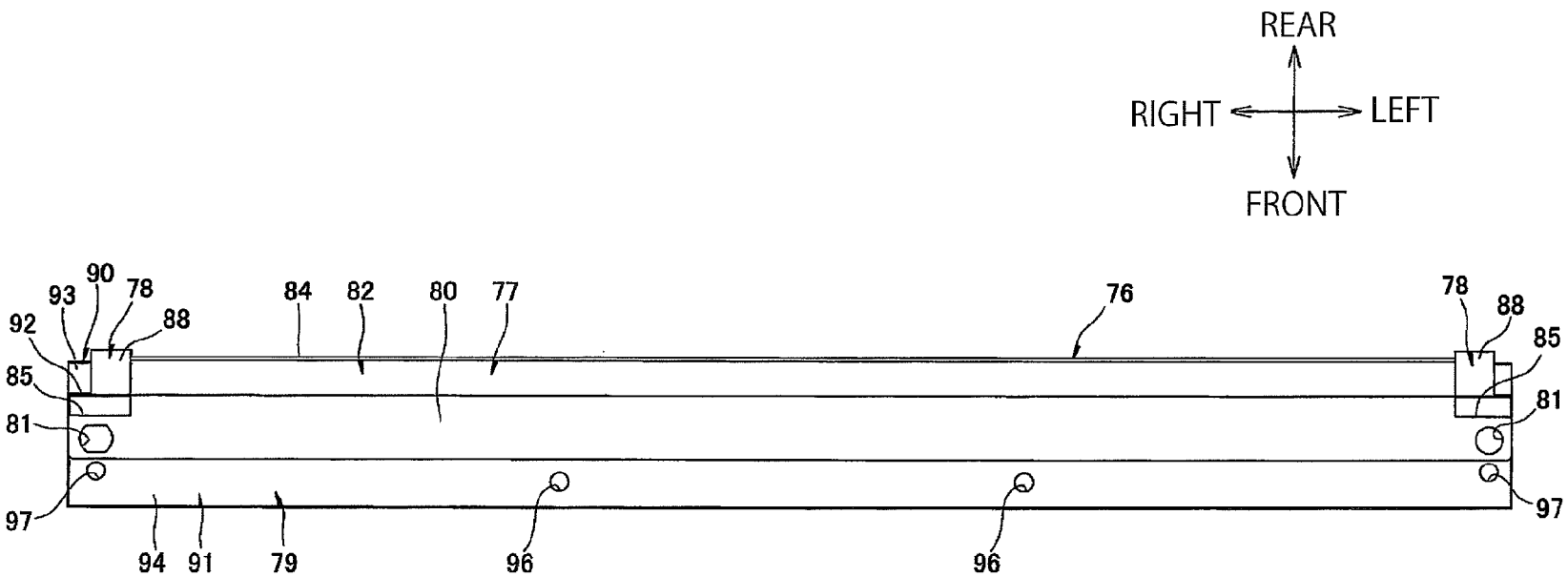
FIG. 4 is a bottom view of a layer thickness regulating blade shown in FIG. 2.

As illustrated in FIG. 5A, the layer thickness regulating blade 76 is provided for regulating the layer thickness of toner carried on the surface of the rubber roller 68 and is supported on an upper surface of the rear-side upper wall 55. Further, as illustrated in FIGS. 3 and 4, the layer thickness regulating blade 76 includes a holder 79 and a blade member 77.

(2-4-1) Holder

As illustrated in FIG. 5A, the holder 79 is formed by bending a metal plate through a bending work and has substantially a crank-like shape as viewed from side. The holder 79 includes a seal holder 90 and a blade holder 91.

The blade holder 91 constitutes a front side portion of the holder 79 and is formed into substantially a rectangular flat-plate shape, as viewed from above, elongated in the left-right direction as illustrated in FIG. 3. As illustrated in FIG. 4, a lower surface of the blade holder 91 is formed as a blade holding surface 94.

As illustrated in FIG. 3, the blade holder 91 has first holder through-holes 95, positioning through-holes 97, and second holder through-holes 96 formed therein. The first holder through-holes 95, positioning through-holes 97, and second holder through-holes 96 penetrate the blade holder 91 in the up-down direction (vertical direction).

The first holder through-holes 95, each of which has substantially a circular shape as viewed from above, are positioned at both left and right end portions of the blade holder 91 in correspondence with the plurality of (two) first screw holes 41, respectively.

The positioning through-holes 97, each of which has substantially a circular shape as viewed from above, are positioned on the front side of the first holder through-holes 95 and in correspondence with the plurality of (two) positioning protrusions 42. That is, the first holder through-hole 95 and the positioning through-hole 97 are disposed in series in the front-rear direction at each of the both left and right end portions of the holder 79.

The second holder through-holes 96, each of which has substantially a circular shape as viewed from above, are positioned at a center portion of the blade holder 91 in the left-right direction. The second holder through-holes 96 are spaced apart from each other in the left-right direction in correspondence with the plurality of (two) second screw holes 49.

The seal holder 90 is formed into substantially a flat-plate shape, as viewed from above, elongated in the left-right direction. As illustrated in FIG. 4, a lower surface of the seal holder 90 is formed as a seal holding surface 93.

As illustrated in FIG. 5A, a rear end portion of an upper surface of the blade holder 91 and a front end portion of a lower surface (seal holding surface 93) of the seal holder 90 are connected to each other.

As a result, a rear surface of the blade holder 91 and lower surface (seal holding surface 93) of the seal holder 90 constitute a step portion 92 at the rear end portion of the blade holder 91 and front end portion of the seal holder 90.

(2-4-2) Blade Member

As illustrated in FIGS. 3, 4, and 5A, the blade member 77 is formed of a thin metal plate having elasticity and has substantially a flat-plate shape elongated in the left-right direction. A front side portion of the blade member 77 is formed as a held portion 80 to be held by the blade holding surface 94, and a rear side portion of the blade member 77 is formed as an elastic portion 82.

As illustrated in FIG. 3, the held portion 80 is formed into substantially a rectangular flat-plate shape, as viewed from above, elongated in the left-right direction.

The elastic portion 82 is formed into substantially a rectangular flat-plate shape, as viewed from above, elongated in the left-right direction and is connected to the held portion 80 so as to be inclined upward toward the rear from a rear end portion of the held portion 80, as illustrated in FIG. 5A.

A rear end portion of the elastic portion 82 is bent by bending work so as to curve upward. More specifically, the rear end portion of the elastic portion 82 is formed into a contact portion 84 that has substantially a circular arc shape as viewed from side.

Further, as illustrated in FIG. 3, the blade member 77 has blade through-holes 81 and blade cut portions 85 formed therein.

The blade through-holes 81, each of which has substantially a circular shape as viewed from above, are positioned at both left and right end portions of the held portion 80 in correspondence with the plurality of (two) first screw holes 41. The blade through-holes 81 penetrate the blade member 77 in the up-down direction (vertical direction).

The blade cut portions 85 are formed at both left and right end portions of the blade member 77. The blade cut portions 85 are formed by cutting both left and right end portions of the elastic portion 82 and portions of the held portion 80 on the rear sides of the blade through-holes 81 each in substantially a rectangular shape as viewed from above (see FIG. 4).

As illustrated in FIG. 4, the held portion 80 is adhesively bonded to the blade holding surface 94 such that the blade through-holes 81 and the first holder through-holes 95 (see FIG. 3) communicate with each other in the up-down direction (vertical direction) and, thereby, the blade member 77 is held by the blade holder 91.

As a result, as illustrated in FIG. 5A, in the layer thickness regulating blade 76, the seal holder 90, the blade holder 91, and the blade member 77 are arranged such that the seal holding surface 93 is located on an opposite side of the blade member 77 with respect to the blade holding surface 94. In other words, the blade member 77 is attached onto the blade holding surface 94 that confronts downwardly in the up-down direction (vertical direction), and the seal holding surface 93 is located at a higher level than the blade holding surface 94 in the up-down direction (vertical direction).

(2-5) Side Edge Seal

As illustrated in FIGS. 3 and 4, the side edge seals 78 are attached to the seal holding surface 93 of the seal holder 90 at a pair of left and right side positions that are adjacent to the left and right edges of the seal holder 90 in the left-right direction so that the elastic portion 82 of the blade member 77 is sandwiched between the side edge seals 78 in the left-right direction. Among the side edge seals 78, one side edge seal 78 that is positioned near the right edge of the seal holder 90 will be referred to as "right side edge seal 78", while the other side edge seal 78 that is positioned near the left edge of the seal holder 90 will be referred to as "left side edge seal 78" hereinafter.

Each of the side edge seals 78 is formed into substantially a rectangular shape as viewed from above and includes a second base member 87 and a second raised fabric member 88.

The second base member 87 is formed of elastic foam such as an urethane sponge member and has substantially a rectangular shape as viewed from above.

The second raised fabric member 88 is formed of fabric such as a fiber material of Teflon (registered trade mark) and has lengths in the front-rear and left-right directions substantially equal to those of the second base member 87. The second raised fabric member 88 is adhesively bonded to a lower surface of the second base member 87.

Figure 6A:
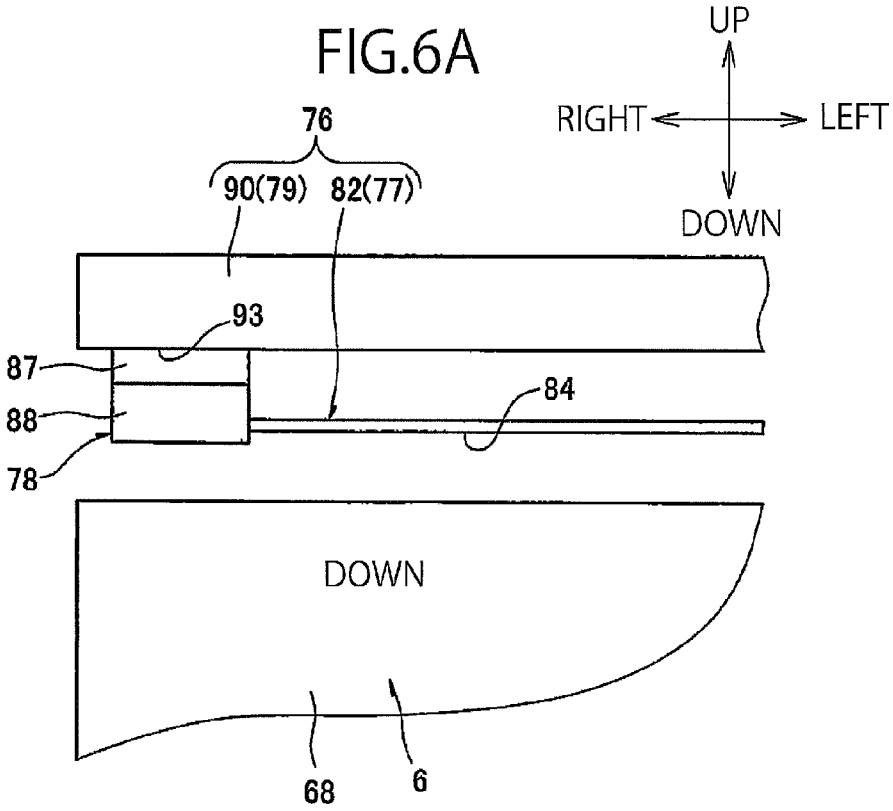

As illustrated in FIG. 6A, upper surfaces of the second base members 87 of the side edge seals 78 are adhesively bonded to the seal holding surface 93 and, thereby, the side edge seals 78 are held by the seal holder 90 such that both left and right end faces (left and right end surfaces) of the elastic portion 82 of the blade member 77 abut against left-right directional inner-side edge faces (left-right directional inner-side end surfaces) of the respective second raised fabric members 88. More specifically, the right side edge face of the elastic portion 82 of the blade member 77 abuts against the left side edge face of the second raised fabric member 88 in the right side edge seal 78 (see FIG. 6A), and the left side edge face of the elastic portion 82 of the blade member 77 abuts against the right side edge face of the second raised fabric member 88 in the left side edge seal 78. Further, a lower end portion of the second raised fabric member 88 protrudes further downward from the elastic portion 82 of the blade member 77.

(2-6) Assembly of Developing Frame and Layer Thickness Regulating Blade

The layer thickness regulating blade 76 is assembled to the developing frame 30, to which the side seals 71 and developing roller 6 have already been mounted in the manner described above.

In order to assemble the layer thickness regulating blade 76 to the developing frame 30, first, as illustrated in FIG. 3, the layer thickness regulating blade 76 is mounted, from above, on the rear-side upper wall 55 of the developing frame 30. At this time, the positioning protrusions 42 of the first fixing portions 40 are inserted through the positioning through-holes 97 of the blade holder 91. At the same time, the first screw holes 41 of the first fixing portions 40 are exposed through the blade through-holes 81 and the first holder through-holes 95, and the second screw holes 49 of the second fixing portions 46 are exposed through the second holder through-holes 96.

Then, two screw members 99 are screwed into the first screw holes 41 through the first holder through-holes 95 and the blade through-holes 81. Further, two screw members 99 are screwed into the second screw holes 49 through the second holder through-holes 96.

Thus, as illustrated in FIG. 2, the holder 79 is fixed to the developing frame 30, whereby the assembly of the layer thickness regulating blade 76 to the developing frame 30 is completed.

Figure 6B:
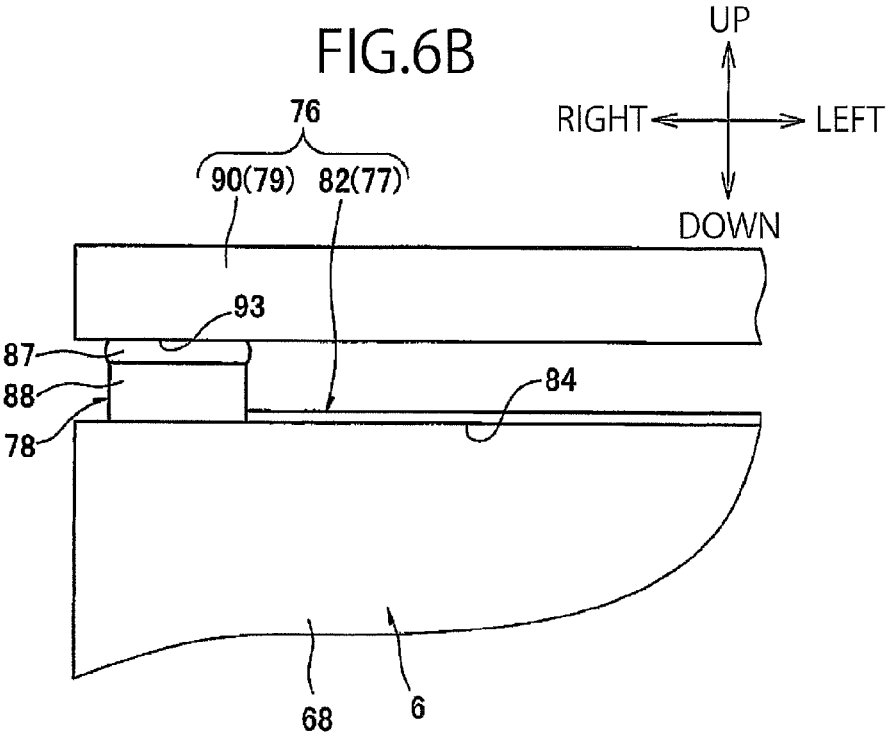

At this time, as illustrated in FIG. 6B, the side edge seals 78 and the contact portion 84 of the layer thickness regulating blade 76 are brought into contact from above with the rubber roller 68 of the developing roller 6.

More specifically, the second raised fabric members 88 of the side edge seals 78 are brought into contact with the both left and right end portions of the peripheral surface of the rubber roller 68, and a lower surface of the contact portion 84 is brought into contact with the left-right directional center portion of the peripheral surface of the rubber roller 68. That is, lower surfaces of the second raised fabric members 88 and the lower surface of the contact portion 84 are flush with each other in the up-down direction.

Before the layer thickness regulating blade 76 is assembled to the developing frame 30, the lower end portions of the second raised fabric members 88 protrude further downward from the elastic member 82 of the blade member 77. So, when the lower surfaces of the second raised fabric members 88 and the lower surface of the contact portion 84 are flush with each other in the up-down direction, the second base members 87 are elastically deformed by the protruding amount.

Thus, the second raised fabric members 88 are brought into pressingly contact with the left and right end portions of the peripheral surface of the rubber roller 68 due to the elastic force of the second base members 87. That is, the second raised fabric members 88 are pressed against the peripheral surface of the rubber roller 68.

As illustrated in FIG. 5A, the upper portion 61 of the side upper seal 59 is disposed so as to be sandwiched between a lower surface of a front side portion of the blade member 77 and the upper surface of the side upper seal accommodating portion 60.

Further, as illustrated in FIG. 5B, the side seals 71 are disposed so as to be sandwiched between the left and right side ends (see FIG. 3) of the peripheral surface of the rubber roller 68 and the rear surfaces of the side seal accommodating portions 48. An upper end portion of each side seal 71 is brought into contact with the lower surface of the front side portion of the second raised fabric member 88. In the upper end portion of the side seal 71, a downstream end portion in the rotation direction X is disposed so as to be sandwiched between the second raised fabric member 88 and the rubber roller 68.

Further, as illustrated in FIG. 5A, the blade member 77 is disposed such that, at a contact portion between the rubber roller 68 and the contact portion 84, the rotation direction X of the developing roller 6 and a direction Y (from front to rear direction) directed from a front end portion of the blade member 77 toward a rear end portion of the blade member 77 coincide with each other.

3. Functions and Effects (1) In the developing cartridge 23, the side edge seals 78 and blade member 77 are held by the holder 79 in a state that the side edge seals 78 are brought into contact with the left and right end portions of the blade member 77.

This prevents generation of a gap, which may occur due to the thickness of the side edge seals 78, between the contact portion 84 and the rubber roller 68.

As a result, the layer thickness of the toner carried on the surface of the developing roller 6 can be reliably regulated, and also, the toner can be prevented from leaking from the gap between the blade member 77 and the rubber roller 68.

Thus, according to the developing cartridge 23 of the present embodiment, the layer thickness of the toner carried on the surface of the rubber roller 68 can be regulated reliably while the number of parts constituting the layer thickness regulating blade 76 can be reduced, and leakage of toner from the developing frame 30 can be prevented.

(2) The seal holding surface 93 is located on the opposite side of the blade member 77, which is held by the blade holding surface 94, with respect to the blade holding surface 94. Thus, even with a simple configuration, a space for holding the side edge seals 78 can be ensured.

This reliably prevents generation of a gap, which may occur due to the thickness of the side edge seals 78, at a boundary between the contact portion 84 and the rubber roller 68.

(3) Further, the seal holder 90 and blade holder 91 constitute the step portion 92, allowing the seal holding surface 93 to be located on the opposite side of the blade member 77 with respect to the blade holding surface 94 with a simple and reliable manner.

(4) Further, the seal holder 90 and blade holder 91 are integrally formed by bending a metal plate, so that as compared to a case where the seal holder 90 and blade holder 91 are formed from separate members, the number of parts can be reduced.

(5) Further, as illustrated in FIG. 6A, the left and right edge faces of the blade member 77 abut against the left-right directional inner-side end surfaces of the second raised fabric members 88 of the side edge seals 78. Accordingly, when the contact portion 84 is brought into contact with the rubber roller 68 as illustrated in FIG. 6B, the second raised fabric members 88 of the side edge seals 78 can be reliably brought into contact with the left and right end portions of the rubber roller 68.

Thus, leakage of toner from between the second raised fabric members 88 and rubber roller 68 can be reliably prevented.

Particularly, the second base members 87 are elastically deformed, and the second raised fabric members 88 are brought into pressingly contact with the both left and right end portions of the peripheral surface of the rubber roller 68 due to the elastic force of the second base member 87, thereby allowing the second raised fabric members 88 and left and right end portions of the rubber roller 68 to be stably brought into contact with each other.

(6) Further, as illustrated in FIG. 5A, the blade member 77 is disposed such that, at the contact portion between the rubber roller 68 and contact portion 84, the rotation direction X of the developing roller 6 and direction Y directed from the front end portion of the blade member 77 toward the rear end portion of the blade member 77 coincide with each other, thereby allowing reduction in size of the developing cartridge 23.

Because the blade member 77 is thus disposed in the developing cartridge 23, toner peeled off by the blade member 77 is accumulated at a portion on the upstream side of the contact part between the rubber roller 68 and contact portion 84 in the rotation direction X of the developing roller 6. However, in the developing cartridge 23 of the present embodiment, generation of a gap between the blade member 77 and developing roller 6 is prevented. So, toner is prevented from leaking from between the blade member 77 and developing roller 6. Leakage of toner from the developing frame 30 can be prevented, while the size of the developing cartridge 23 is reduced.

4. Second Embodiment

A second embodiment of the developing device according to the present invention will be described with reference to FIGS. 7A and 7B. In the second embodiment, the same reference numerals are given to the same components as in the first embodiment and a description thereof will be omitted.

In the above-described first embodiment, as illustrated in FIG. 6A, the left-right directional edge faces of the elastic portion 82 abut against the left-right directional inner-side end surfaces of the side edge seals 78.

Figure 7A:
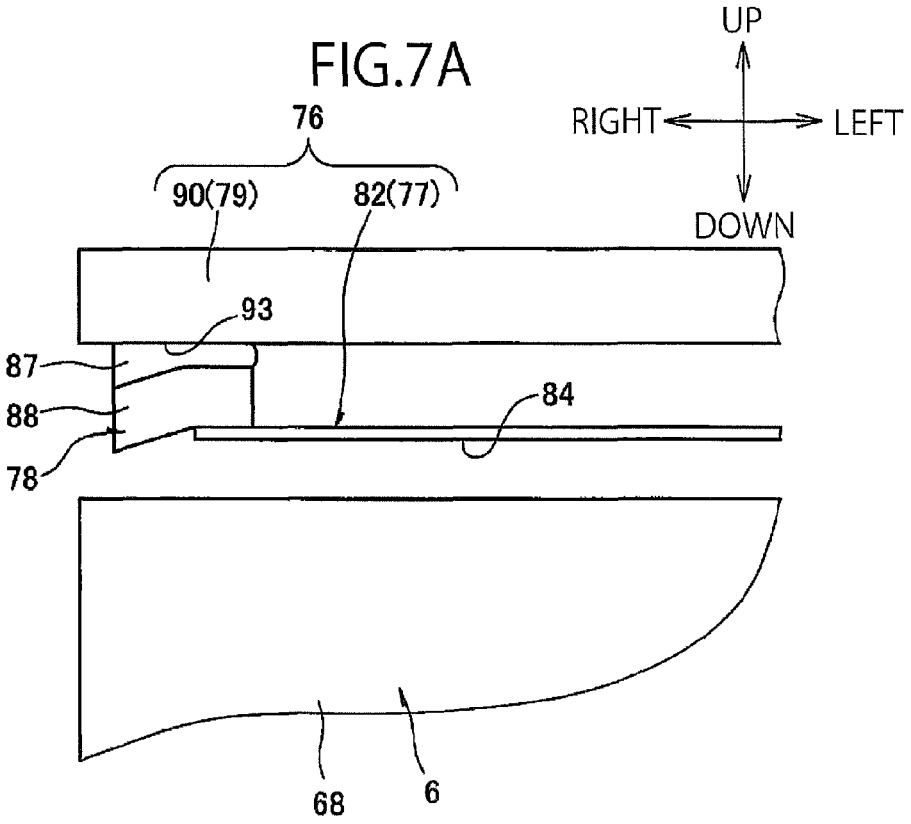

On the other hand, in the second embodiment, as illustrated in FIG. 7A, left-right directional inner side portions of the side edge seals 78 are disposed so as to be sandwiched between the seal holding surface 93 of the holder 79 and the left-right directional end portions of the upper surface of the elastic portion 82 of the blade member 77 in the up-down direction (vertical direction). That is, the left side portion of the right side edge seal 78 is sandwiched between the seal holding surface 93 and the right side end portion of the elastic portion 82 (see FIG. 7A) in the up-down direction (vertical direction), and the right side portion of the left side edge seal 78 is sandwiched between the seal holding surface 93 and the left side end portion of the elastic portion 82 in the up-down direction (vertical direction).

Also in the second embodiment having the above-described configuration, the same functions and effects as those of the first embodiment can be obtained.

Further, because the left-right directional inner side portions of the side edge seals 78 are sandwiched between the seal holding surface 93 and the left and right end portions of the elastic portion 82 of the blade member 77, the left-right directional inner side portions of the second base members 87 are elastically deformed to cause the left-right directional outer side portions of the second raised fabric members 88 to protrude (bulge) further downward from the elastic portion 82 before the layer thickness regulating blade 76 is assembled to the developing frame 30 as shown in FIG. 7A.

Figure 7B:
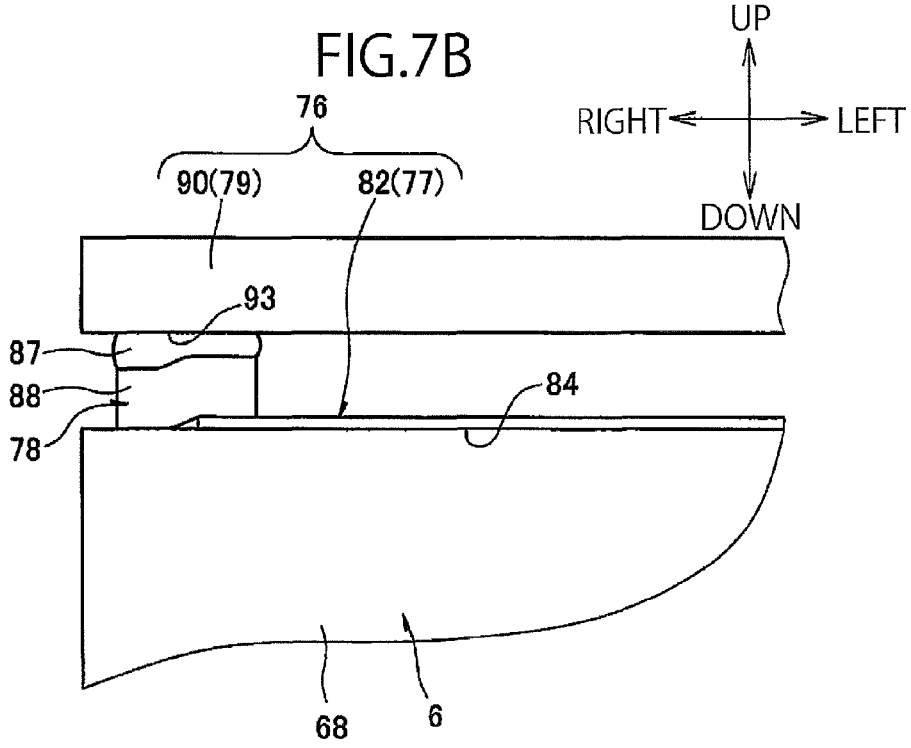

When the layer thickness regulating blade 76 is assembled to the developing frame 30, as illustrated in FIG. 7B, the side edge seals 78 and contact portion 84 of the layer thickness regulating blade 76 are brought into contact from above with the rubber roller 68 of the developing roller 6.

More specifically, the lower surfaces of the left-right directional outer side portions of the second raised fabric members 88 of the side edge seals 78 are brought into contact with the both left-right directional end portions of the peripheral surface of the rubber roller 68, and the lower surface of the contact portion 84 is brought into contact with the left-right directional center portion of the peripheral surface of the rubber roller 68. That is, the lower surfaces of the left-right directional outer side portions of the second raised fabric members 88 and the lower surface of the contact portion 84 are flush with each other in the up-down direction.

Before the layer thickness regulating blade 76 is assembled to the developing frame 30, the lower end portions of the left-right directional outer side portions of the second raised fabric members 88 protrude further downward from the elastic portion 82 of the blade member 77. So, when the lower surfaces of the left-right directional outer side portions of the second raised fabric members 88 and the lower surface of the contact portion 84 are flush with each other in the up-down direction, the left-right directional outer side portions of the second base members 87 are elastically deformed by the protruding amount.

Thus, the left-right directional outer side portions of the second raised fabric members 88 are brought into pressingly contact with the left-right directional end portions of the peripheral surface of the rubber roller 68 due to the elastic force of the second base members 87.

As a result, leakage of toner from between the second raised fabric members 88 and the left-right directional end portions (left and right end portions) of the rubber roller 68 can be reliably prevented.

5. Third Embodiment

A third embodiment of the developing device of the present invention will be described with reference to FIG. 8.

In the first embodiment, as illustrated in FIG. 5A, the holder 79 is formed by bending a metal plate and integrally includes the seal holder 90 and the blade holder 91.

Figure 8:
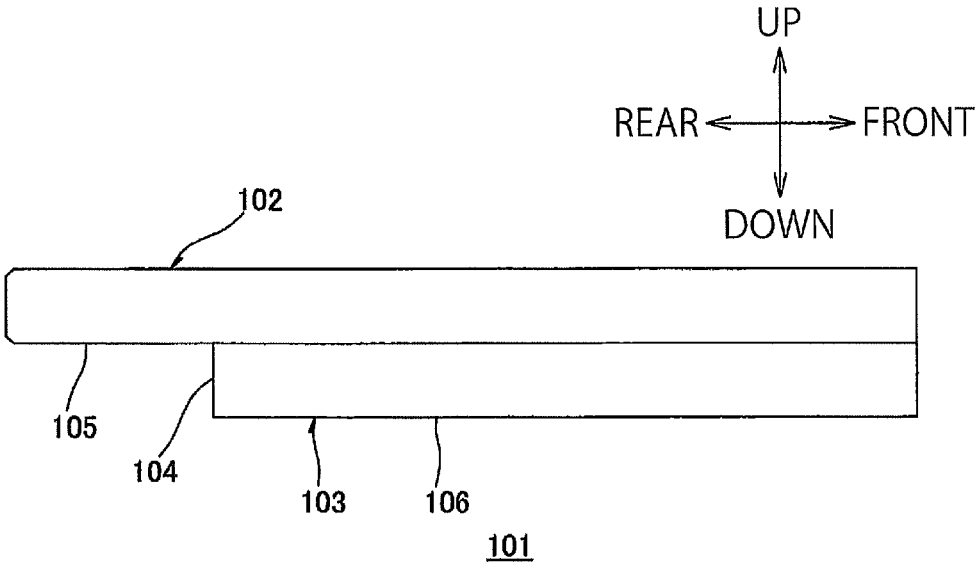
FIG. 8 is a side view of a holder of a layer thickness regulating blade in a developing cartridge according to a third embodiment.

On the other hand, in the third embodiment, as illustrated in FIG. 8, a holder 101 is employed in place of the holder 79. The holder 101 includes, as separate members, a seal holder 102 and a blade holder 103.

The seal holder 102 is formed of metal material, for example, and has substantially a flat-plate shape extending in the front-rear direction. A lower surface of the seal holder 102 is formed as a seal holding surface 105.

The blade holder 103 is formed of plastic (resin) material, for example, and has substantially a flat-plate shape extending in the front-rear direction. A front-rear directional length of the blade holder 103 is shorter than that of the seal holder 102. A lower surface of the blade holder 103 is formed as a blade holding surface 106.

The blade holder 103 is fixed to the seal holding surface 105 of the seal holder 102 by being adhesively bonded to the seal holding surface 105 such that a front end portion of the blade holder 103 and a front end portion of the seal holder 102 are flush with each other in the up-down direction (vertical direction).

As a result, a rear side portion of the seal holding surface 105 is exposed from the blade holder 103. Further, the seal holding surface 105 exposed from the blade holder 103 and a rear surface of the blade holder 103 constitute a step portion 104 at a rear end portion of the blade holder 103 and a front end portion of the exposed part in the seal holder 102.

Also in the third embodiment having the above-described configuration, the same functions and effects as those of the first embodiment can be obtained.

Simply by fixing the blade holder 103 to the seal holding surface 105, the step portion 104 is formed by the thickness of the blade holder 103. So, in order to form the step portion 104, it is unnecessary to perform any additional processing for forming the step portion 104. This enhances production efficiency of the holder 101.

Further, the seal holder 102 is formed of metal material, for example, and the blade holder 103 is formed of plastic (resin) material, for example. So, material cost can be reduced while stiffness of the holder 101 is maintained.

Although the seal holder 102 is formed of metal material and the blade holder 103 is formed of plastic (resin) material in the third embodiment, the present invention is not limited to this configuration. For example, the seal holder 102 may be formed of plastic (resin) material, and the blade holder 103 may be formed of metal material.

The above-described configurations in the first through third embodiments can be combined in various ways.

While the invention has been described in detail with reference to the embodiments thereof, it would be apparent to those skilled in the art that various changes and modifications may be made therein without departing from the spirit of the invention.

What is claimed is:

1. A developing device comprising:

a casing configured to accommodate developer therein;

a developer bearing member mounted in the casing so as to be rotatable about its axis and configured to bear developer thereon;

a layer thickness regulating member mounted in the casing and configured to regulate thickness of a layer of developer borne on a surface of the developer bearing member; and a seal member that is in contact with an end portion of the developer bearing member in an axial direction of the developer bearing member, the layer thickness regulating member including:

a first plate-shaped member having a pair of opposite ends in a perpendicular direction that is perpendicular to the axial direction of the developer bearing member, one end in the pair of opposite ends being in contact with the developer bearing member, the other end being supported by the casing; and a second plate-shaped member that is fixedly secured to the casing and that supports the first plate-shaped member, the seal member being in contact with an end portion of the first plate-shaped member in the axial direction of the developer bearing member, and the second plate-shaped member holding the seal member such that the seal member is located between the second plate-shaped member and the developer bearing member.

2. The developing device according to claim 1, wherein the second plate-shaped member includes:

a first holding portion having a first holding surface that holds the seal member thereon; and a second holding portion having a second holding surface that holds the first plate-shaped member thereon, the first holding surface being positioned on an opposite side of the first plate-shaped member with respect to the second holding surface.

3. The developing device according to claim 2, wherein the first holding portion and the second holding portion are arranged to form a step.

4. The developing device according to claim 3, wherein the first holding portion and the second holding portion are integrally formed with each other from a metal plate, the step portion being formed by bending the metal plate.

5. The developing device according to claim 3, wherein the first holding portion and the second holding portion are formed from separate members, the step portion being formed by attaching the second holding portion onto the first holding surface.

6. The developing device according to claim 5, wherein either one of the first holding portion and the second holding portion is formed from resin, and the other one of the first holding portion and the second holding portion is formed from metal.

7. The developing device according to claim 1, wherein an end face of the first plate-shaped member in the axial direction of the developer bearing member is in abutment contact with an inner-side end face of the seal member in the axial direction of the developer bearing member.

8. The developing device according to claim 1, wherein an inner-side end portion of the seal member in the axial direction of the developer bearing member is sandwiched between the second plate-shaped member and the end portion of the first plate-shaped member in the axial direction of the developer bearing member.

9. The developing device according to claim 1, wherein the one end has a contact portion being in contact with the developing bearing member, and wherein the first plate-shaped member is positioned such that a rotation direction of the developer bearing member at the contact portion is substantially the same as a direction directed from the other end to the one end of the first plate-shaped member in the perpendicular direction.

10. A developing device comprising:

a casing configured to accommodate developer therein;

a developer bearing member mounted in the casing so as to be rotatable about its axis and configured to bear developer thereon;

a layer thickness regulating member mounted in the casing and configured to regulate thickness of a layer of developer borne on a surface of the developer bearing member; and a seal member that is in contact with an end portion of the developer bearing member in an axial direction of the developer bearing member, the layer thickness regulating member including:

a first plate-shaped member having a pair of opposite ends in a perpendicular direction that is perpendicular to the axial direction of the developer bearing member, one end in the pair of opposite ends being in contact with the developer bearing member, the other end being supported by the casing; and a second plate-shaped member that is fixedly secured to the casing and that supports the first plate-shaped member, the seal member being in contact with an end portion of the first plate-shaped member in the axial direction of the developer bearing member, and the second plate-shaped member holding the seal member, wherein the second plate-shaped member includes:

a first holding portion having a first holding surface that holds the seal member thereon; and a second holding portion having a second holding surface that holds the first plate-shaped member thereon, the first holding surface being positioned on an opposite side of the first plate-shaped member with respect to the second holding surface.

11. The developing device according to claim 10, wherein the first holding portion and the second holding portion are arranged to form a step.

12. The developing device according to claim 11, wherein the first holding portion and the second holding portion are integrally formed with each other from a metal plate, the step portion being formed by bending the metal plate.

13. The developing device according to claim 11, wherein the first holding portion and the second holding portion are formed from separate members, the step portion being formed by attaching the second holding portion onto the first holding surface.

14. The developing device according to claim 13, wherein either one of the first holding portion and the second holding portion is formed from resin, and the other one of the first holding portion and the second holding portion is formed from metal.

15. The developing device according to claim 10, wherein an end face of the first plate-shaped member in the axial direction of the developer bearing member is in abutment contact with an inner-side end face of the seal member in the axial direction of the developer bearing member.

16. The developing device according to claim 10, wherein an inner-side end portion of the seal member in the axial direction of the developer bearing member is sandwiched between the second plate-shaped member and the end portion of the first plate-shaped member in the axial direction of the developer bearing member.

17. The developing device according to claim 10, wherein the one end has a contact portion being in contact with the developing bearing member, and wherein the first plate-shaped member is positioned such that a rotation direction of the developer bearing member at the contact portion is substantially the same as a direction directed from the other end to the one end of the first plate-shaped member in the perpendicular direction.

* * * * *